US005941409A

United States Patent [19]

Leaderman

[11] Patent Number: 5,941,409

[45] Date of Patent: Aug. 24, 1999

[54] TEAPOT CUP

[76] Inventor: Richard N. Leaderman, 82 Tanglewood Dr., Longmeadow, Mass. 01106

[21] Appl. No.: 08/908,684

[22] Filed: Aug. 7, 1997

[51] Int. Cl.[6] ..... B65D 47/00

[52] U.S. Cl. ..... 220/717; 220/703

[58] Field of Search ..... 220/771, 717, 220/703, 661

[56] References Cited

U.S. PATENT DOCUMENTS

| | | | |
|---|---|---|---|
| D. 27,886 | 11/1897 | Rogers | 220/717 X |
| D. 247,541 | 3/1978 | Barger | 220/717 X |
| 2,608,841 | 9/1952 | Rice | 220/717 X |
| 2,627,735 | 2/1953 | Dexter | 220/703 |
| 2,646,200 | 7/1953 | Atkins | 220/703 X |
| 5,542,670 | 8/1996 | Morano | 220/711 X |
| 5,702,025 | 12/1997 | Di Gregorio | 220/717 |

*Primary Examiner*—Steven Pollard
*Attorney, Agent, or Firm*—Malcolm J. Chisholm, Jr.

[57] ABSTRACT

A teapot cup is shown for brewing and drinking a heated beverage such as tea. The teapot cup includes a cup body having a cup base and a cup wall surrounding the base to define a liquid chamber. A drinking spout is secured to the cup wall and defines a liquid passage extending between a screened entry passage secured to the cup body adjacent the cup base and a mouthpiece positioned adjacent a top edge of the cup wall. The drinking spout includes a lip flair secured to the mouthpiece. Openings in the screened entry passage are dimensioned to permit flow of liquid into the liquid passage, but to restrict passage of particles having a length of a longest axis greater than one millimeter, such as tea leaves. A cup handle is secured to the cup wall and is positioned within a handle range that is between thirty-five degrees and one-hundred and thirty-five degrees from the drinking spout. In use of the teapot cup, a user selects a desired type and amount of dry tea leaves, and stirs them into hot water within the liquid chamber. When the tea beverage has reached a desired strength, the user lifts the cup body by the cup handle; places the lip flair of the drinking spout mouthpiece on the user's lower lip and tips the cup body to allow the tea beverage to flow into the user's mouth through the spout.

16 Claims, 1 Drawing Sheet

TEAPOT CUP

BACKGROUND OF THE INVENTION

The present invention relates to containers for preparing heated aromatic beverages, and especially relates to a container for brewing tea.

It is well known that gourmet coffee houses have become increasingly popular in recent times wherein people may select a specific coffee to enjoy from a variety of coffees having different tastes and aromas. While such varieties of coffees have grown in public acceptance, teas have not experienced a similar surge in popularity, even though varieties of spiced and aromatic teas are widely available. A primary reason teas have not grown with coffees in contemporary popularity is due to inherent limitations of traditional methods and mechanics of brewing tea in America.

Most tea provided to diners is served with a fixed amount of a specific dried tea within a liquid permeable bag in a cup of hot water. In order to control strength of the resulting tea beverage (e.g., the relative concentration of tea solutes and suspended particles in the water solvent), the diner must extract the tea bag after a certain time period. If the bag is left in too long, the tea may be too strong; if taken out too early, the tea may be too weak. The length of time to achieve a desired strength of tea also depends on a temperature of the water in the cup in which the tea is being brewed. The temperature is often an unknown however, and a tea drinker may wait the normal specific time period before removing the bag, only to find the tea beverage is too weak and too cool to properly enjoy.

An alternative method of brewing tea eliminates some of those problems by providing a teapot wherein the relative amount of tea and hot water may be varied to achieve a desired strength and the teapot keeps the tea warmer during brewing than would an open cup. However, teapots typically provide a greater volume of tea than can be enjoyed by a single diner, and are therefore too costly to satisfy selective tastes of individual connoisseurs of heated beverages. Small teapots appropriate for a single diner are similarly prohibitively costly requiring both a teapot and a separate cup for one user, in contrast to a single cup required for a gourmet coffee drinker.

Another tea-brewing alternative is to encase a specific amount of tea in a finely screened tea ball or hollow container that may be immersed in a cup of hot water. When the tea beverage achieves a satisfactory strength, the tea ball is removed. While such a device overcomes limitations of a paper or cloth tea bag by enabling a user to vary the amount of tea used for a cup of water, such tea balls are typically metal and can slightly alter the resulting tea flavor (unless fabricated of expensive precious metals); are costly to manufacture; must be meticulously cleaned; and are highly conductive of heat, tending to cool the beverage. Moreover, using a tea ball to custom brew a cup of tea would require a user to manipulate the ball with her or his hands in order to insert the selected tea leaves into the ball, again jeopardizing the resulting flavor with contaminants from the user's hands.

Many European connoisseurs of tea have observed that optimum tea flavor is achieved by teapots that permit dry tea leaves to be freely dispersed within a hot water solvent for a specific amount of time, thereby avoiding localized areas of excessively high concentrations of tea solutes or suspended particles that ultimately diminish the overall flavor of the resulting tea beverage. It is theorized that freely dispersed tea leaves experience uniform temperature transitions that enhance uniform dissolving of tea solutes for enhanced flavor and aroma, in contrast to concentrated tea quantities in a bag or tea ball, wherein tea leaves at an exterior layer of the concentrated tea quantity necessarily experience a different temperature transition upon exposure to hot water than do tea leaves located at a central area of the concentrated tea quantity. In use of teapots with freely dispersed tea leaves, when a desired strength of the tea beverage is achieved, the tea leaves are screened out of the beverage as it is poured into a cup for the tea drinker. Use of the metal tea ball or any bagged tea in known teapots or cups cannot achieve such a delicate relationship between the tea and brewing water as do freely dispersed tea leaves in the brewing water. However, it is necessary with known tea brewing methods and containers to use both a teapot, a screen and a cup to produce such a high quality tea beverage.

A contemporary gourmet coffee house environment invites connoisseurs of heated beverages to savor their special drink in an unhurried, relaxing fashion. Because of the above described limitations of conventional methods and containers for brewing tea, it is not practical to custom brew an individual cup of tea so that the resulting tea beverage has a consistent flavor that is a specific flavor sought by an individual tea drinker.

Accordingly, it is a general object of the present invention to provide a tea brewing and drinking container that overcomes cost and quality problems of the prior art.

It is a more specific object to provide a tea brewing and drinking container that enables a user to select a specific amount of selected, dried tea leaves for each cup of tea to be brewed.

It is yet another specific object to provide a tea brewing and drinking container that permits tea leaves to be freely dispersed throughout heated brewing water while the tea is being brewed.

It is a further object to provide a tea brewing and drinking container that enables a user to comfortably drink the brewed tea beverage from the brewing container without first removing the tea leaves from the container.

These and other objects and advantages of this invention will become more readily apparent when the following description is read in conjunction with the accompanying drawings.

SUMMARY OF THE INVENTION

A teapot cup is disclosed for brewing and drinking a heated beverage such as tea. In a particular embodiment, the teapot cup comprises a cup body including a cup base and a cup wall surrounding the base and extending upward away from the base to define a liquid chamber having a liquid entry opening surrounded by a top edge of the wall; a drinking spout that defines a liquid passage extending between a screened entry passage secured to the cup body adjacent the cup base and a mouthpiece positioned adjacent the top edge of the wall, wherein the mouthpiece includes a lip flair and openings defined in the screened entry passage are dimensioned to permit flow of liquid from the liquid containing chamber into the liquid passage and to restrict passage of particles having a length of a longest axis of any particle that is greater than one millimeter; and a cup handle having a handle base end secured adjacent the cup base and a handle top end secured adjacent the top edge of the cup body, the handle defining a finger opening between the wall of the cup and the cup handle, the cup handle being positioned within a handle range that is between thirty-five degrees and one-hundred and thirty-five degrees from the drinking spout about an axis perpendicular to the base of the cup passing through a center of the liquid chamber. In an alternative embodiment, the teapot cup also includes a brewing lid dimensioned to sit on the top edge of the cup body and enclose the liquid chamber, wherein the brewing lid defines an edge groove that receives the top edge to prevent the lid from sliding off of the cup body, and the lid further includes a drip ridge dimensioned to surround the top edge within the liquid chamber so that drops of any liquid condensing on the lid flow by gravity off of the drip ridge and back into the liquid chamber of the cup whenever the brewing lid is on the top edge of the cup.

In use of the teapot cup, a user selects a desired type and amount of dry tea leaves, and stirs them into hot water within the liquid chamber. The brewing lid may then be placed on the top edge of the cup body to restrain loss of heat from the brewing tea. When the tea beverage has reached a desired strength, the user lifts the cup body by the cup handle; places the lip flair of the drinking spout mouthpiece on the user's mouth and tips the cup body to allow the tea beverage to flow into the user's mouth through the spout. The teapot cup enables the user to select a desired type and amount of dried tea leaves; to keep the tea beverage warm while it is brewing; and to carefully monitor increasing strength of the tea until it has reached a desired strength for drinking; all in one convenient, efficient and comfortable container.

DETAILED DESCRIPTION OF THE PREFERRED EMBODIMENTS

Figure 1:
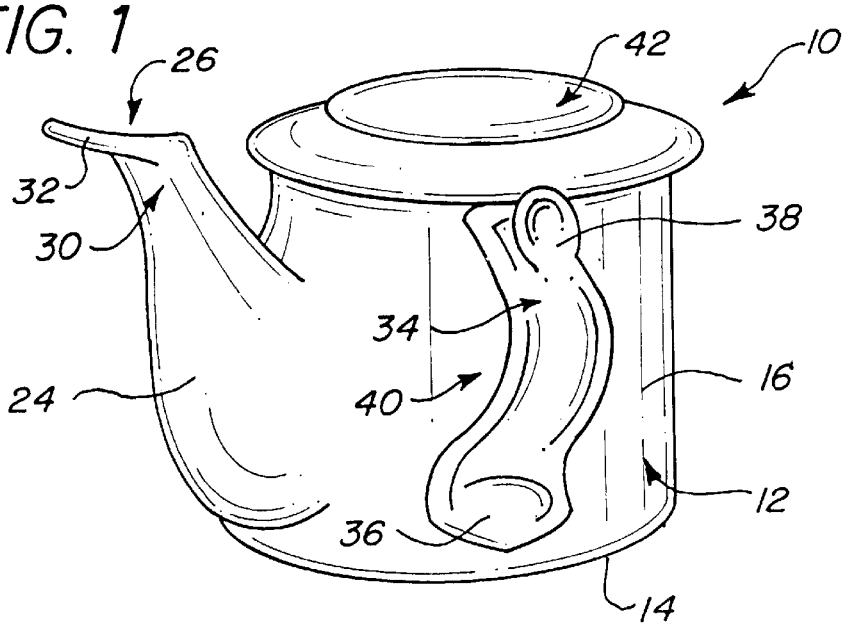
FIG. 1 is a side perspective view of a teapot cup constructed in accordance with the present invention, showing a brewing lid positioned on the cup.
Figure 2:
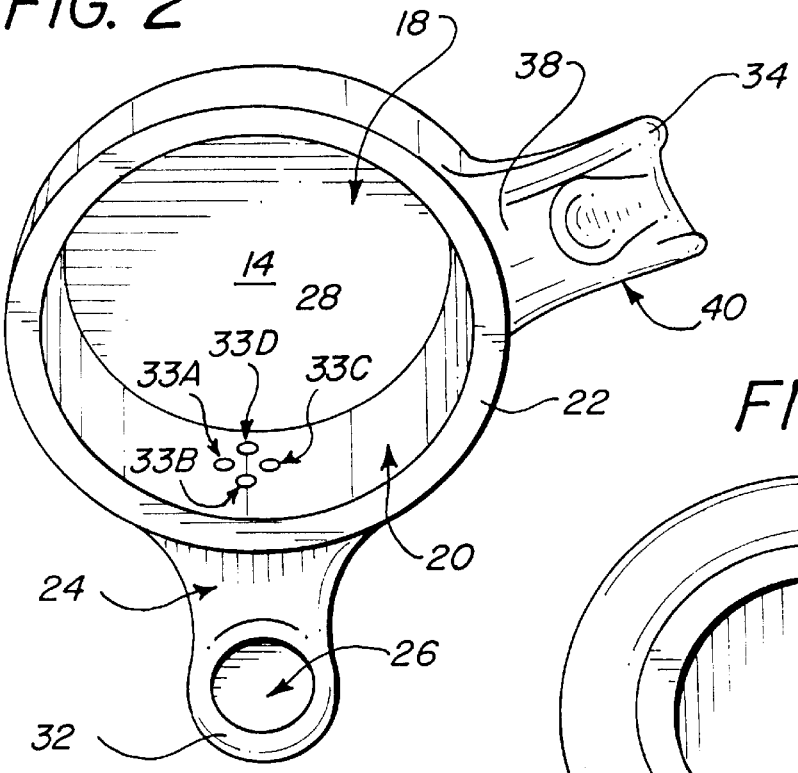
FIG. 2 is a top perspective view of the FIG. 1 teapot cup showing a screened entry passage within a liquid chamber adjacent a base of the cup body.

Referring to the drawings in detail, a teapot cup of the present invention is shown and generally designated by the reference numeral 10. As best shown in FIGS. 1 and 2, the teapot cup 10 includes a cup body 12 having a cup base 14 and a cup wall 16 surrounding the base and extending upward away from the base to define a liquid chamber 18 having a liquid entry opening 20 surrounded by a top edge 22 of the wall 16.

A drinking spout 24 defines a liquid passage 26 extending between a screened entry passage 28 secured to the cup body 12 adjacent the cup base 14 and a mouthpiece 30. The mouthpiece 30 includes a lip flair 32 extending away from the liquid passage 26 and top edge 22 of the cup wall 16 in a direction parallel to a plane defined by the liquid entry opening 20 a distance that is greater than one-half a largest diameter of the liquid passage 26 adjacent the mouthpiece 30. As best seen in FIG. 2, the lip flair 32 may be a flattened extension of the material making up the drinking spout 24. The lip flair 32 may include a slight "V" contour so tea beverage flows primarily in a center of the "V", which would be closest to the cup base 12. The lip flair 32 serves to disperse heat of the tea beverage as it passes into the user's mouth (not shown), and, when the lip flair 32 is placed upon a user's lower lip, the lip flair allows the tea beverage to flow into the user's mouth as with a traditional cup top edge, so that the user's mouth does not have to completely encircle the drinking spout 24 and the user does not have to apply any suction to the spout to drink the tea beverage. Experimentation has demonstrated that a larger lip flair extending even further away from the top edge 22 and liquid passage 26 of the drinking spout 24, such as extending a distance that is greater than a largest diameter of the liquid passage 26 adjacent the mouthpiece 30, provides even greater facility in use of the teapot cup 10. However, a larger lip flair 32 requires greater care in transport, use, and cleaning, because a larger lip flair is readily susceptible to damage by chipping or cracking.

As shown in FIG. 2, the screened entry passage 28 of the drinking spout 24 defines a plurality of screen openings 33A, 33B, 33C, 33D wherein each screen opening defines a longest diameter of about 1 millimeter so that the screen openings permit flow of liquid from the liquid chamber 18 of the cup body 12 into the liquid passage 26 of the drinking spout 24 and restrict flow of particles having a length of a longest axis of any particle that is greater than one millimeter.

The teapot cup 10 also includes a cup handle 34 having a handle base end 36 secured adjacent the cup base 14 and a handle top end 38 secured adjacent the top edge 22 of the cup body 12. The cup handle 34 defines a finger opening 40 between the wall 16 of the cup and the handle 34 for a user to pick up the cup with her or his fingers (not shown). The cup handle 34 is positioned within a handle range of between thirty-five degrees and one-hundred and thirty-five degrees from the drinking spout 24 about an axis perpendicular to the base 14 of the cup passing through a center of the liquid chamber 18. In FIGS. 1 and 2, the cup handle 34 is shown positioned to a right side of the drinking spout 24, however the handle range of the present invention means "between thirty-five degrees and one-hundred and thirty five-degrees from the drinking spout 24 about an axis perpendicular to the base 14 of the cup", whether viewing that axis from above the top edge 22 of the cup wall 16 toward the cup base 14 (as in FIG. 2), or viewing that axis from an opposite perspective from the base 14 toward the top edge 22. Therefore, the handle range includes positioning the cup handle 34 within a handle range on the right or left side of the drinking spout, so that users that are left-handed or right-handed may use the teapot cup 10 with equal facility.

Figure 3:
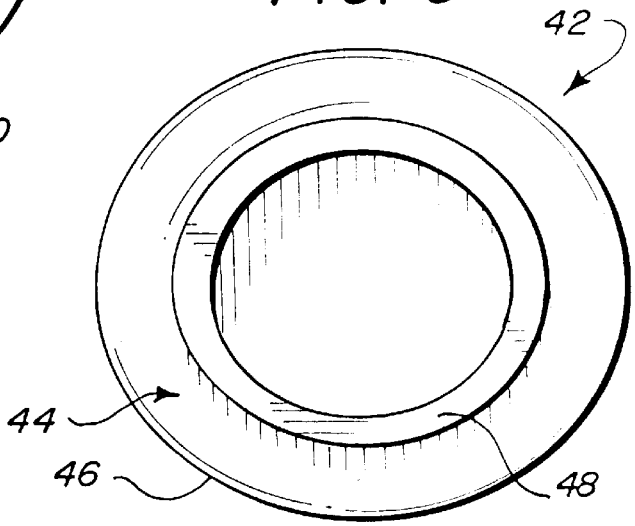
FIG. 3 is a bottom perspective view of the FIG. 1 brewing lid of the teapot cup.

In an alternative embodiment, the teapot cup 10 also includes a brewing lid 42 dimensioned to sit on the top edge 22 of the cup body 12 and enclose the liquid chamber 18, as shown in FIG. 1. The brewing lid 42 includes an edge groove 44 (shown in FIG. 3) adjacent a peripheral edge 46 dimensioned to engage the top edge 22 of the cup body 14 to prevent the lid 42 from sliding off of the edge in use. The edge groove 44 may completely encircle the brewing lid 42 as shown in FIG. 3, or it may be positioned at only a portion or portions of the peripheral edge 46 of the lid 42. The brewing lid may also include a drip ridge 48 encircling the brewing lid 42 and dimensioned to abut the top edge 22 of the cup body 12 and to descend below the top edge 22 into the liquid chamber 18 so that any droplets forming by condensation on the brew lid 42 during brewing of a heated beverage within the liquid chamber 18 will flow by gravity toward and onto the drip ridge 48 and then fall back into the liquid chamber rather than flowing to the peripheral edge 46 of the brew lid 42 to fall out of the liquid chamber 18.

In use of the teapot cup, a user selects a desired type and amount of dry tea leaves (not shown) and stirs them into hot water within the liquid chamber 18. The brewing lid 42 may then be placed on the top edge 22 of the cup body 12 to restrain heat loss from the liquid chamber while the tea brews. The user may observe the strength of the tea visually by lifting the brew lid 42 off of the cup body 12 to note changing color of the tea beverage, or by tasting minute portions of the beverage through the drinking spout. When the tea has reached a desired strength, the user simply lifts the teapot cup 10 by its cup handle 34; places the lip flair 32 of the drinking spout 24 on her or his bottom lip in ordinary fashion; and then tilts the teapot cup 10 upward so that the tea beverage flows out of the liquid chamber and through the liquid passage 26 of the spout 24 and into the mouth of the user. Because the cup handle 34 is positioned between thirty-five degrees and one-hundred and thirty-five degrees from the drinking spout 24, tilting of the teapot cup 10 for sipping the tea is greatly facilitated.

Experimentation with a variety of positions of the cup handle 34 has demonstrated that an optimal position for ease of usage of the teapot cup 10 is within a handle range that is about forty-five degrees from the drinking spout, affording a user ample room for insertion of the user's fingers through the finger opening 40 of the cup handle, while minimizing a distance the handle must be moved to tilt the teapot cup 10 for comfortable drinking of the tea.

While the present invention has been described and illustrated with respect to a specific construction of a teapot cup 10, it will be understood by those skilled in the art that the present invention is not limited to this particular example. Accordingly, reference should be made primarily to the attached claims rather than to the foregoing specification to determine the scope of the claimed invention.

What is claimed is:

1. A teapot cup for brewing and drinking a heated beverage such as tea, comprising:

a. a cup body including a cup base and a cup wall surrounding the base and extending upward away from the base to define a liquid chamber having a liquid entry opening surrounded by a top edge of the wall;

b. a drinking spout that defines a liquid passage extending between a screened entry passage secured to the cup body adjacent the cup base and a mouthpiece positioned adjacent the top edge of the wall wherein the mouthpiece includes a flattened lip flair having a slight "V" contour, the flattened lip flair extending away from the liquid passage and top edge in a direction parallel to a plane defined by the liquid entry opening a distance that is greater than one-half a largest diameter of the liquid passage adjacent the mouthpiece so that, when the flattened lip flair is placed on a lower lip of a user, the heated beverage flows into the user's mouth and the user's mouth does not have to completely encircle the drinking spout and the user does not have to apply suction to the drinking spout to drink the heated beverage; and c. a cup handle positioned within a handle range that, is between thirty-five degrees and one-hundred and thirty-five degrees from the drinking spout about an axis perpendicular to the base of the cup passing through a center of the liquid chamber.

2. The teapot cup of claim 1, wherein the mouthpiece includes a lip flair that extends away from the liquid passage and top edge in a direction parallel to a plane defined by the liquid entry opening a distance that is greater than a largest diameter of the liquid passage adjacent the mouthpiece.

3. The teapot cup of claim 1, wherein the screened entry passage defines a plurality of screen openings and each screen opening defines a longest diameter of about one millimeter so that the screen openings permit flow of liquid from the liquid chamber of the cup body into the liquid passage of the drinking spout and restrict flow of particles having a length of a longest axis of any particle that is greater than one millimeter.

4. The teapot cup of claim 1, further comprising a brewing lid dimensioned to sit on the top edge of the cup body and enclose the liquid chamber, the brewing lid including an edge groove adjacent a peripheral edge of the brewing lid dimensioned to engage the top edge.

5. The teapot cup of claim 4, wherein the brewing lid includes a drip ridge encircling the brewing lid and dimensioned to abut the top edge of the cup body and to descend below the top edge into the liquid chamber.

6. A teapot cup for brewing and drinking a heated beverage such as tea, comprising:

a. a cup body including a cup base and a cup wall surrounding the base and extending upward away from the base to define a liquid chamber having a liquid entry opening surrounded by a top edge of the wall;

b. a drinking spout that defines a liquid passage extending between a screened entry passage secured to the cup body adjacent the cup base and a mouthpiece positioned adjacent the top edge of the wall; and, c. a flattened lip flair having a slight "V" contour, the flattened lip flair secured to the drinking spout adjacent the mouthpiece extending away from the liquid passage of the drinking spout and top edge of the cup wall in a direction parallel to a plane defined by the liquid entry opening a distance that is greater than one-half a largest diameter of the liquid passage adjacent the mouthpiece so that, when the flattened lip flair is placed on a lower lip of a user, the heated beverage flows into the user's mouth and the user's mouth does not have to completely encircle the drinking spout and the user does not have to apply suction to the drinking spout to drink the heated beverage.

7. The teapot cup of claim 6, wherein the lip flair extends away from the liquid passage of the drinking spout a distance that is greater than a largest diameter of the liquid passage adjacent the mouthpiece.

8. The teapot cup of claim 6, wherein the screened entry passage defines a plurality of screen openings and each screen opening defines a longest diameter of about one millimeter so that the screen openings permit flow of liquid from the liquid chamber of the cup body into the liquid passage of the drinking spout and restrict flow of particles having a length of a longest axis of any particle that is greater than one millimeter.

9. The teapot cup of claim 6, further comprising a brewing lid dimensioned to sit on the top edge of the cup body and enclose the liquid chamber, the brewing lid including an edge groove adjacent a peripheral edge of the brewing lid dimensioned to engage the top edge.

10. The teapot cup of claim 9, wherein the brewing lid includes a drip ridge encircling the brewing lid and dimensioned to abut the top edge of the cup body and to descend below the top edge into the liquid chamber.

11. A teapot cup for brewing and drinking a heated beverage such as tea, comprising:

a. a cup body including a cup base and a cup wall surrounding the base and extending upward away from the base to define a liquid chamber having a liquid entry opening surrounded by a top edge of the wall;

b. a drinking spout that defines a liquid passage extending between a screened entry passage secured to the cup body adjacent the cup base and a mouthpiece positioned adjacent the top edge of the wall wherein the mouthpiece includes a flattened lip flair having a slight "V" contour, the flattened lip flair extending away from the liquid passage and top edge in a direction parallel to a plane defined by the liquid entry opening a distance that is greater than one-half a largest diameter of the liquid passage adjacent the mouthpiece so that, when the flattened lip flair is placed on a lower lip of a user, the heated beverage flows into the user's mouth and the user's mouth does not have to completely encircle the drinking spout and the user does not have to apply suction to the drinking spout to drink the heated beverage; and c. a cup handle having a handle base end secured adjacent the cup base and a handle top end secured adjacent the top edge of the cup body, the handle defining a finger opening between the wall of the cup and the cup handle, the cup handle being positioned within a handle range that is between thirty-five degrees and one-hundred and thirty-five degrees from the drinking spout about an axis perpendicular to the base of the cup passing through a center of the liquid chamber.

12. The teapot cup of claim 11, wherein the cup handle is positioned within a handle range that is about forty-five degrees from the drinking spout about an axis perpendicular to the base of the cup passing through a center of the liquid chamber.

13. The teapot cup of claim 12, wherein the mouthpiece includes a lip flair that extends away from the liquid passage and top edge in a direction parallel to a plane defined by the liquid entry opening a distance that is greater than a largest diameter of the liquid passage adjacent the mouthpiece.

14. The teapot cup of claim 11, wherein the screened entry passage defines a plurality of screen openings and each screen opening defines a longest diameter of about one millimeter so that the screen openings permit flow of liquid from the liquid chamber of the cup body into the liquid passage of the drinking spout and restrict flow of particles having a length of a longest axis of any particle that is greater than one millimeter.

15. The teapot cup of claim 14, further comprising a brewing lid dimensioned to sit on the top edge of the cup body and enclose the liquid chamber, the brewing lid including an edge groove adjacent a peripheral edge of the brewing lid dimensioned to engage the edge.

16. The teapot cup of claim 15, wherein the brewing lid includes a drip ridge encircling the brewing lid and dimensioned to abut the top edge of the cup body and to descend below the top edge into the liquid chamber.

* * * * *